US006237196B1

(12) United States Patent
Fujiwara

(10) Patent No.: US 6,237,196 B1
(45) Date of Patent: May 29, 2001

(54) TOP ROLLER OF A DRAFTING APPARATUS

(75) Inventor: Michiaki Fujiwara, Kameoka (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/500,545

(22) Filed: Feb. 9, 2000

(30) Foreign Application Priority Data

Feb. 15, 1999 (JP) ..... 11-035426

(51) Int. Cl.[7] ..... D01H 5/56
(52) U.S. Cl. ..... 19/295; 19/258
(58) Field of Search ..... 19/258, 236, 295; 29/898.07, 898.09, 898.062, 898.064; 492/16, 38, 39, 42, 47; 384/517, 518, 563

(56) References Cited

U.S. PATENT DOCUMENTS 1,882,480 * 10/1932 Brueshaber ..... 492/39
4,116,506 * 9/1978 Moritomo et al. ..... 384/518
4,476,614 * 10/1984 Pittroff ..... 29/898.09
5,341,569 * 8/1994 Takamizawa et al. ..... 29/898.09
5,556,209 * 9/1996 Obara et al. ..... 384/517
5,655,846 * 8/1997 Obara ..... 29/898.09
6,012,226 * 1/2000 Obara ..... 29/898.09

FOREIGN PATENT DOCUMENTS 9-157966 6/1997 (JP) .

* cited by examiner

*Primary Examiner*—John J. Calvert
*Assistant Examiner*—Gary L. Welch
(74) *Attorney, Agent, or Firm*—Armstrong, Westerman, Hattori, McLeland & Naughton, LLP

(57) ABSTRACT

The shaft 13 of a top roller T of a drafting device D is segmented into sections. The bearing holding section 13*e* includes a large diameter section at the base end and small diameter section 13*e*' on the far end. A first bearing 14*c* is fitted over the large diameter section, and a second bearing 14*d* having a total diameter equivalent to the first bearing 14*c*, is fitted over the small diameter section 13*e*'.

2 Claims, 3 Drawing Sheets

TOP ROLLER OF A DRAFTING APPARATUS

FIELD OF THE INVENTION

The present invention relates to a top roller used in the drafting apparatus of a spinning frame to draft a sliver.

BACKGROUND OF THE INVENTION

Drafting devices are well known in the art. FIG. 2 and FIG. 3 show a typical prior art drafting apparatus, and the internal structure of a typical prior art top roller, respectively.

Referring to FIG. 2, a drafting apparatus D utilizing a four-point drafting system is comprised of four roller units: a front roller unit 1 (comprising front top roller 1*a* and front bottom roller 1*b*), a second roller unit 2 (comprising second top roller 2*a* provided with apron 2*a*', and second bottom roller 2*b* provided with apron 2*b*'), a third roller unit 3 (comprising third top roller 3*a* and third bottom roller 3*b*), and a back roller unit 4 (comprising back top roller 4*a* and back bottom roller 4*b*). Front top roller 1*a,* second top roller 2*a,* third top roller 3*a,* and back top roller 4*a* are all held by a bearing or the like arranged inside pivotable arm unit D'.

Downstream of the drafting apparatus D, the spinning frame also includes a spinning unit 5 that spins the drafted sliver into a yarn y using, for example, a vortex air current; and a nip roller 6*a* capable of freely contacting and separating from a delivery roller 6*b* that is continually rotated. The yarn y fed from the spinning unit 5 is nipped between the nip roller 6*a* and the delivery roller 6*b,* and fed downstream to a guide bar 7, a slack tube 8 and a yarn clearer 9 before being wound into a package 10 rotated by contact with a rotationally driven friction roller 11.

After being drawn from a sliver container 12, the sliver s is drafted by the drafting apparatus D, and spun into yarn y by the spinning unit 5. Next, the spun yarn y is nipped between the nip roller 6*a* and the delivery roller 6*b,* fed past the guide bar 7, the yarn clearer 9 and so on, and wound into the wound package 10 which is rotated in contact with the friction roller 11.

In reference to FIG. 3, the structure of the conventional prior art top roller T will now be explained. It should be noted that all the top rollers of the drafting apparatus D, including the front top roller 1*a,* second top roller 2*a,* third top roller 3*a,* and back top roller 4*a,* all share the structure shown in the drawing.

The top roller T includes a shaft 13 which is held by a bearing or the like mounted to the pivotable arm unit D'. The shaft 13 is comprised of three main sections: a bearing holding section 13*a* that supports an outside bearing 14*a* on the end of the bearing holding section 13*a,* and an inside bearing 14*b* at the base of the bearing holding section 13*a,* each bearing 14*a,* 14*b* having the same diameter and spaced a predetermined distance apart; a central section 13*b* having a diameter slightly larger than the bearing holding section 13*a;* and a base section 13*c* having a diameter slightly larger than the central section 13*b*. A washer 15 having a total diameter slightly larger than the inner diameter of the bearings 14*a,* 14*b,* is affixed to the end of the bearing holding section 13*a* with a bolt 16. The washer 15 prevents the bearings 14*a,* 14*b* from dislodging from the bearing holding section 13*a*.

A pressure applying spring 17, arranged between the two bearings 14*a,* 14*b,* simultaneously presses the outside bearing 14*a* against the washer 15, and presses the inside bearing 14*b* against the facing wall 13*d* formed at the juncture of the bearing holding section 13*a* and the central section 13*a* of the shaft 13. A tubular spacer 18 is formed around the periphery of the pressure applying spring 17, and arranged between the two bearings 14*a,* 14*b*. A roller tube 19 fixedly engages the bearings 14*a,* 14*b,* and encloses the central section 13*b* and bearing holding section 13*a* of the shaft 13, the bearings 14*a,* 14*b,* the pressure applying spring 17, and the spacer 18.

A C-ring 20 is arranged between a circular groove around the circumference of the spacer 18 and a matching circular groove formed on the inner surface of the roller tube 19, the C-ring 20 fixedly engaging the spacer 18 with the roller tube 19, and holding the spacer 18 and the roller tube 19 at a predetermined relative position. A cover 21 is fixedly inserted into the end of the roller tube 19, and an O-ring 22 is fixedly engaged to a circumferential groove cut into the surface of the central section 13*b* of the shaft 13 help prevent fibrous waste and other matter from entering the inner parts of the top roller T roller.

A top-cot 23 is attached around the circumference of the roller tube 19 and roughly envelopes the area occupied by the bearings 14*a,* 14*b*. The top-cot 23 makes contact with the sliver s that is drafted.

The bearing holding section 13*a* of this prior art shaft 13 of the top roller T supports the bearings 14*a,* 14*b,* and is formed to a uniform diameter generally between 6 mm and 8 mm. When the bearing holding section 13*a* has a small diameter (6 mm, for example), rigidity is sacrificed, and the bearing holding section 13*a* tends to warp under the heavy load generated by drafting the sliver. Another consequence of using the shaft 13 with a small diameter bearing holding section is that when the top roller T is attached or removed from the drafting apparatus D, large shocks such as might be caused by dropping the top roller T may also cause the shaft 13 to bend. Bends or warps in the shaft 13 lead to drafting abnormalities and flaws in the spun yarn y.

Rigidity of the shaft 13 can be improved when the bearing holding section 13*a* of the shaft 13 is larger (8 mm in diameter, for example), but when the bearing holding section 13*a* is larger, the balls 14*a*', 14*b*' in the bearings 14*a,* 14*b* must be made smaller, thereby reducing the durability and longevity of the bearings 14*a,* 14*b*.

In order to solve these problems of the conventional top roller of the drafting apparatus, it is an object of the present invention to provide a top roller that is light, rigid, and durable, and can be attached and removed without concern about damaging the shaft.

SUMMARY OF THE INVENTION

In order to accomplish this object, in the present invention, a top roller arranged on the shaft via a pair of the bearings having the same outer diameter firstly comprises a sectional shaft having a bearing holding section and the base section of which has a larger diameter than the end section, secondly a second bearing is arranged loosely on the end section of the bearing holding section, and thirdly a pressure applying spring is arranged between the two bearings so as to exert pressure against the bearings.

Since, according to the first aspect of the present invention, most of the bearing holding section of the shaft has a large diameter, the shaft is rigid, and reduces the tendency of the shaft to warp under the load of drafting the sliver, or become bent due to large shocks. On the other hand, since the end of the bearing holding section has a small diameter, the bearing that is fit over this section is large enough to support normal balls in the bearing, and improves the longevity of the bearing.

In a second aspect of the present invention, the second bearing is arranged loosely on the end section of the bearing holding section of the shaft, thereby facilitating assembly and disassembly of the top roller, and attachment and removal of the top roller from the drafting apparatus.

In a third aspect of the present invention, a pressure applying spring is arranged between the two bearings, thereby further facilitating assembly and disassembly, and further protecting the bearings against shocks.

DETAILED DESCRIPTION OF THE PREFERRED EMBODIMENTS

Figure 1:
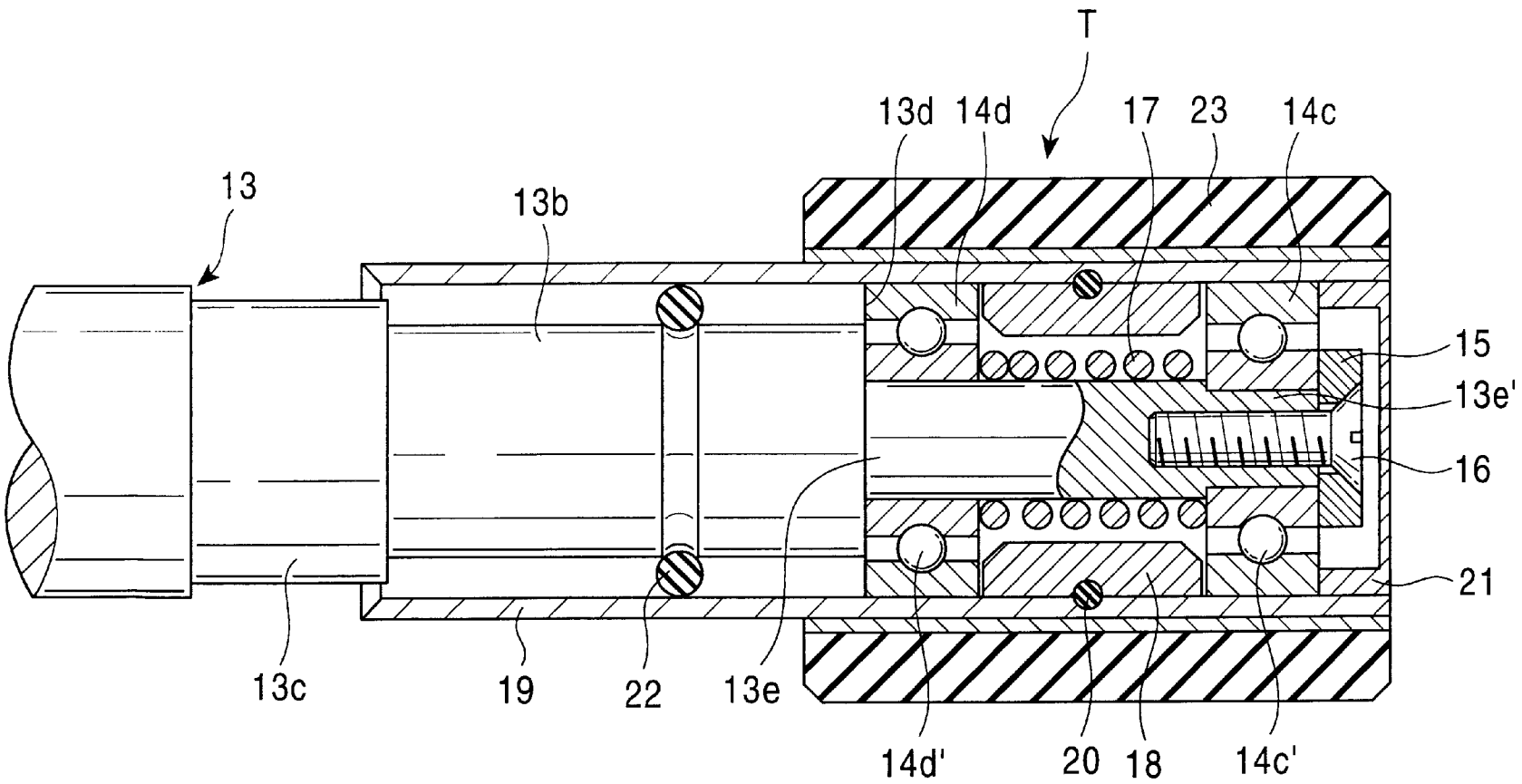
FIG. 1 is a cross-sectional view of the top roller of the present invention.
Figure 2:
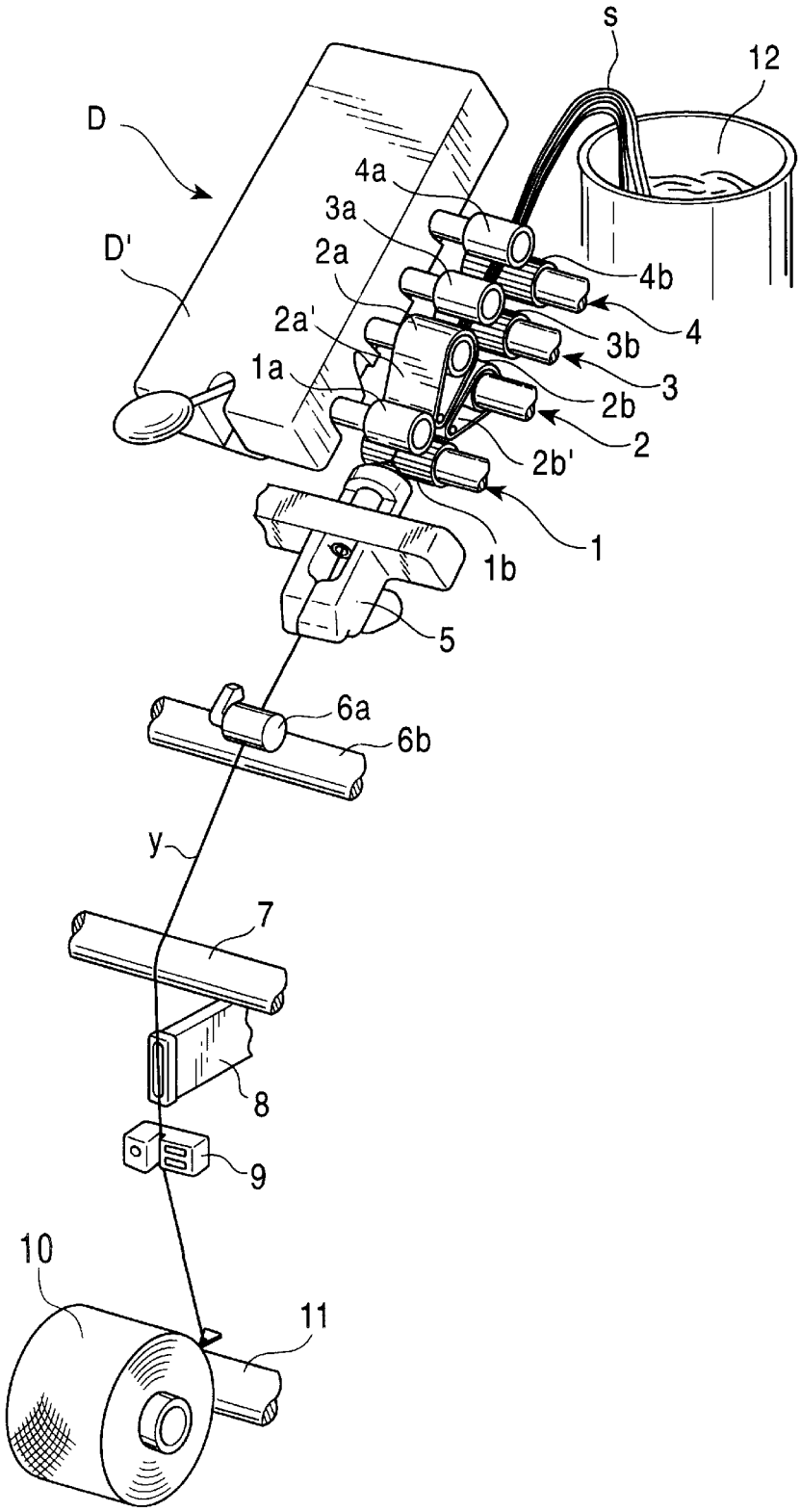
FIG. 2 PRIOR ART
FIG. 2 shows a typical prior art drafting apparatus.
Figure 3:
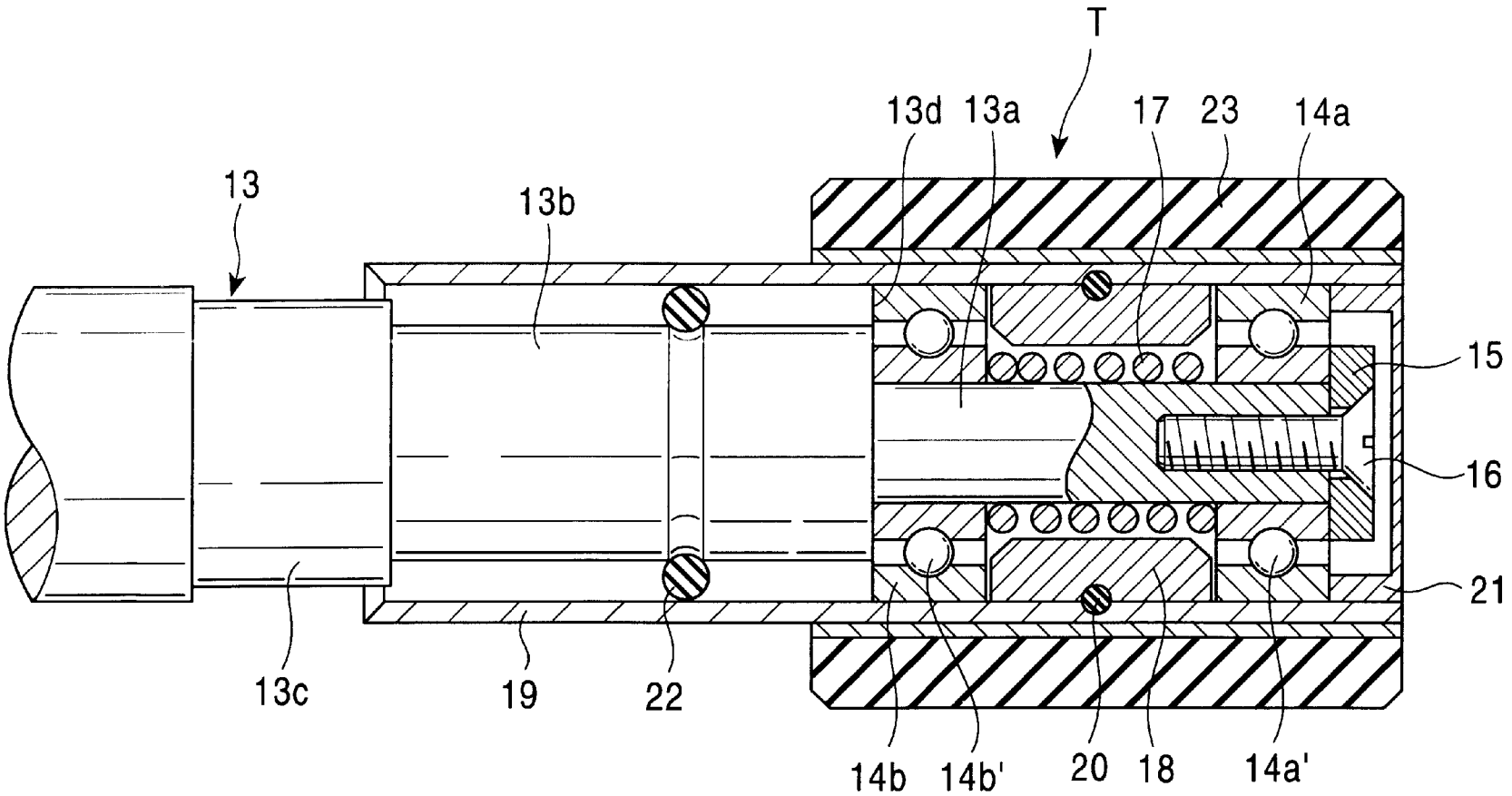
FIG. 3 PRIOR ART
FIG. 3 is a cross-sectional view of a typical prior art top roller used in a typical drafting apparatus.

A detailed description of an embodiment of the top roller of the present invention will now be described with reference to FIG. 1.

In the embodiment described hereinbelow, the top roller itself is similar to that described in the prior art top roller T. Like elements in this detailed embodiment use the same reference numbers as used in the prior art. Attention is drawn, however, to the fact that the bearing holding section 13*a* of the shaft 13, and the bearings 14*a*, 14*b* described in the prior art top roller T have been modified in the present description, and these elements do not appear hereinbelow as numbered in the prior art top roller T.

As in the prior art description, the shaft 13, which is supported by an outside bearing 14*a* on the end of the bearing holding section 13*a*, and an inside bearing 14*b* at the base of the bearing holding section 13*a*, each bearing 14*a*, 14*b* having the same diameter and spaced a predetermined distance apart. In the case of the present invention, however, the far tip 13*e*' of the bearing holding section 13*e* is made a smaller diameter (6 mm, for example) than the rest of the bearing holding section 13*e* (8 mm, for example). By making only the tip of the bearing holding section 13*e* (the portion that holds the outside bearing 14*c*) to a small diameter, and making the rest of the bearing holding section 13*e* (the portion that holds the inside bearing 14*d*) to a large diameter, the entire bearing holding section 13*e* remains highly rigid. The bearing holding section 13*e* can then bear heavy loads created during drafting of the sliver, and withstand large shocks that might occur when it is fitted or removed from the drafting apparatus, and does not become warped easily.

Although the size of ball 14*d*' in the inside bearing 14*d* is necessarily reduced because the diameter of the bearing holding section 13*e* on which it is supported is large, the ball 14*c*' in the outside bearing 14*c* can be made large because the diameter of the far tip 13*e*' of the bearing holding section 13*e* on which it is supported is small. Thus, the durability and longevity of the outside bearing 14*c* is improved over that of the large shaft prior art top roller. Further, unlike the prior art top rollers where either rigidity must be sacrificed for longevity or vice-versa, the shaft remains highly rigid (about as rigid as the prior art shaft), and the longevity of only one of the bearings is reduced, meaning the overall longevity of the top roller is improved over the large shaft prior art top roller.

When the bearings 14*c*, 14*d* having the same outer diameter are fitted onto the bearing holding section 13*e*, they can be fit snugly around the bearing holding section 13*e*, but since tightly fitted bearings 14*c*, 14*d* can require time and effort to remove, it is preferable to fit them loosely so that they can be easily replaced whenever necessary.

It is also preferable to arrange a pressure applying spring 17 between the bearings 14*c*, 14*d* having the same outer diameter. The pressure applying spring 17 facilitates assembly and disassembly of the top roller T, as well as replacement of the bearings 14*c*, 14*d*. Further, when the roller tube 19 is attached, the pressure applying spring 17 functions as a kind of shock absorber, absorbing shocks that would normally jar the outside bearing 14*c*. This helps prevent wear and tear on the outside bearing 14*c* and improves the longevity of the top roller T.

Thus, as described hereinabove, making the diameter of the far end of the bearing holding section of the shaft smaller than the diameter of the rest of the section increases the rigidity of the bearing holding section, and helps reduce the tendency of the bearing holding section to bend or warp when bearing large loads during sliver drafting, or when absorbing large shocks.

Further, by affixing the bearings loosely to the bearing holding section, it becomes easier to assemble and disassemble the top roller, and easier to attach and remove the top roller from the drafting apparatus.

Still further, since a pressure applying spring is arranged between the two bearings such that it exerts force against the two bearings, the bearings don't slip with the top roller is rotated, and it becomes even easier to assemble and disassemble the top roller, and easier to attach and remove the roller from the drafting apparatus. Further still, when the roller tube is attached, the pressure applying spring functions as a kind of shock absorber, absorbing shocks that would normally jar the outside bearing, helping to prevent untimely damage to the outside bearing.

What is claimed is:

1. A top roller of a drafting apparatus comprising:

a sectional shaft having a bearing holding section;

said bearing holding section having a base section and an end section;

said base section having a larger diameter than said end section;

a first bearing arranged on said base section;

a second bearing having a total diameter equal to that of said first bearing, said second bearing arranged on said end section, and said second bearing is loosely press-fit on said end section of said bearing holding section so as to enable easy assembly and disassembly of the top roller and easy attachment and removal of the top roller from the drafting apparatus.

2. A top roller of a drafting apparatus as in claim 1 wherein a spring is arranged between said first and second bearings such that said spring exerts pressure against said bearings.

* * * * *